US011085630B2

(12) United States Patent
Xu et al.

(10) Patent No.: US 11,085,630 B2
(45) Date of Patent: Aug. 10, 2021

(54) LAMP HAVING MULTIPLE LIGHT EMITTING SURFACES AND PLURALITY OF CONNECTION PORTS

(71) Applicant: NINGBO GANPE OPTOELECTRONICS CO., LTD., Ningbo (CN)

(72) Inventors: Guangrong Xu, Ningbo (CN); Zhongjie Sun, Ningbo (CN); Xiangjun Yu, Ningbo (CN)

( * ) Notice: Subject to any disclaimer, the term of this patent is extended or adjusted under 35 U.S.C. 154(b) by 0 days.

(21) Appl. No.: 16/899,497

(22) Filed: Jun. 11, 2020

(65) Prior Publication Data

US 2021/0018169 A1 Jan. 21, 2021

(30) Foreign Application Priority Data

Jul. 16, 2019 (CN) ..... 201910638870.4

(51) Int. Cl.
*F21V 23/06* (2006.01)
*F21V 33/00* (2006.01)
*F21W 131/301* (2006.01)

(52) U.S. Cl.
CPC ..... *F21V 33/0012* (2013.01); *F21V 23/06* (2013.01); *F21W 2131/301* (2013.01)

(58) Field of Classification Search
CPC ..... F21V 21/002; F21V 23/06; F21V 15/01; F21S 4/28; F21S 8/046
See application file for complete search history.

(56) References Cited

U.S. PATENT DOCUMENTS

| | | | | | |
|---|---|---|---|---|---|
| 4,300,185 | A * | 11/1981 | Wakamatsu | F21S 8/00 | 362/147 |
| 5,658,067 | A * | 8/1997 | Engle | F21S 2/00 | 362/219 |
| 6,536,924 | B2 * | 3/2003 | Segretto | F21S 4/28 | 362/345 |
| 6,670,626 | B2 * | 12/2003 | Witham | A61L 2/10 | 250/504 R |
| 7,954,979 | B2 * | 6/2011 | Sommers | F21V 29/767 | 362/217.01 |
| 9,395,052 | B1 * | 7/2016 | Shew | F21K 9/27 | |
| 9,470,375 | B2 * | 10/2016 | Van Es | F21V 21/005 | |
| 9,482,414 | B2 * | 11/2016 | Cohade | F21V 15/015 | |
| 9,541,266 | B2 * | 1/2017 | Bolscher | F21S 4/28 | |
| 10,352,510 | B2 * | 7/2019 | Van Winkle | F21S 4/10 | |
| 10,663,152 | B2 * | 5/2020 | Sperling | F21V 15/01 | |
| 10,845,029 | B2 * | 11/2020 | Tickner | F21V 23/009 | |
| 2011/0164407 | A1 * | 7/2011 | Stack | F21S 4/20 | 362/125 |

* cited by examiner

*Primary Examiner* — Ismael Negron
(74) *Attorney, Agent, or Firm* — W&K IP

(57) ABSTRACT

The lamp includes a body defining at least front, bottom, rear and end surfaces; a primary light source configured to project light through at least a portion of the front and bottom surface; a secondary light source configured to project light through at least a portion of the rear surface; a processor electrically connected to the primary and secondary light sources; a switch to control the processor; and ports provided on the end surfaces. A sub-lamp assembly and a socket component, each including port configured to connect to the ports on the lamp, might be combined with the lamp to form a luminaire.

6 Claims, 9 Drawing Sheets

LAMP HAVING MULTIPLE LIGHT EMITTING SURFACES AND PLURALITY OF CONNECTION PORTS

CROSS-REFERENCE TO RELATED APPLICATIONS

This application claims priority to Chinese Patent Application No. 201910638870.4 with a filing date of Jul. 16, 2019. The content of the aforementioned applications, including any intervening amendments thereto, are incorporated herein by reference.

TECHNICAL FIELD

The invention relates to the technical field of lighting fixtures, and in particular to a cabinet lamp and a combination luminaire thereof.

BACKGROUND

The cabinet lamp is a luminaire installed in the cabinet to perform an illuminating function. Existing cabinet lamps can only illuminate one side, so only a part of the cabinet can be illuminated. This causes the cabinet to suffer from a large blind area, and it is not very convenient for a user. Moreover, the existing cabinet usually has only one socket. When the socket is used to insert the cabinet lamp, other electronic products cannot be used, which further harms user convenience.

SUMMARY

One technical problem to be solved by the present invention is to provide a cabinet lamp. The cabinet with such a cabinet lamp has a smaller blind area and provides the user more convenience.

One technical solution of the present invention is: a cabinet lamp comprising a lamp body, and the two sides of the lamp body are respectively provided with a light emitting surface.

Preferably, the two light emitting surfaces are respectively a primary light emitting surface and a secondary light emitting surface. The primary light emitting surface is disposed on a front end of the lamp body and arranged in an L shape. The secondary light emitting surface is disposed at a rear end of the lamp body and arranged obliquely.

Preferably, an area of the primary light emitting surface provided on a bottom surface of the lamp body is larger than an area of the primary light emitting surface provided on the side of the lamp body.

Preferably, it further includes a processor and a control switch. Each of the light emitting surfaces is correspondingly provided with a light emitting component, and the light emitting component and the control switch are both electrically connected to the processor.

Compared with the prior art, the present invention has the following advantages: two light emitting surfaces are arranged on the cabinet lamp, so that the cabinet lamps can be illuminated on both the front and the rear. As a result, the cabinet lamp illumination would have a smaller blind area.

The L-shaped primary light emitting surface is deployed so that the cabinet area under the cabinet lamp can be illuminated, as well as a part of an area proximate to the cabinet lamp. The secondary light emitting surface is to be inclined, so that it would illuminate the rear part of the cabinet lamp and an area beneath the rear part. Therefore, the overall illumination blind area would be smaller.

The area of the illuminated bottom surface of the cabinet lamp is made larger than the illuminated area in front of the cabinet lamp, so that it is well adapted to requirements of daily usage and provides more comfort for the user.

And, a control switch provides a control function, so that the primary and secondary lighting components can be turned on as needed to increase convenience for the user.

Another technical problem to be solved by the present invention is to provide a combined luminaire which can be more convenient for users to use.

Another technical solution provided by the present invention is a combination luminaire including a cabinet lamp, which further includes a sub-lamp assembly and a socket component. The sub-lamp assembly and the socket component are detachably electrically coupled to the cabinet lamp.

Preferably, the socket component has a first port. The sub-lamp assembly has a second port. The cabinet lamp has a third port for inserting the first port and a fourth port for inserting the second port respectively. The socket component is electrically connected to the cabinet lamp when the first port is plugged into the third port, and the sub-lamp assembly is electrically connected to the cabinet lamp at this time when the second port is plugged into the fourth port.

Preferably, the third port and the fourth port are arranged together to form a fifth port.

Preferably, the fifth port comprises five connectors, which are an L connector, a GE connector, an N connector, an L1 connector, and an L2 connector. The L connector, the GE connector and the N connector form the third port. The third port matches with the first port of the socket component. The N connector, the L1 connector, and the L2 connector form a fourth port, and the fourth port matches with the second port of the sub-lamp assembly.

Preferably, a part of a first transparent area is arranged on end plates on the left and right ends of the cabinet lamp body. A part of a second transparent area is arranged on end plates on the left and right ends of the sub-lamp assembly. The first transparent area on one side of the cabinet lamp corresponds to the second transparent area on one of side of the sub-lamp assembly when the sub-lamp assembly is mounted to the cabinet lamp.

Compared with the prior arts, the present invention has the following advantages: the sub-lamp and the socket component are provided along with the cabinet lamp, so that the sub-lamp assembly and the socket component can be powered to operate so long as the cabinet lamp is powered on, which is more convenient for the user to use.

The third port and the fourth port are disposed on the cabinet lamp. The second port is disposed on the sub-lamp assembly, and the first port is disposed on the socket component. Therefore, the sub-lamp or the socket component can be used in combination with the cabinet lamp by matching of the different ports.

The third port and the fourth port are formed as an integral port, so that the occupied space is smaller and the usage is more convenient.

A transparent portion is disposed on the end plates of the cabinet lamp and the sub-lamp assembly, so that there would be no dark areas between the sub-lamp assembly and the cabinet lamp when the sub-lamp assembly is mounted on the cabinet lamp, and the illumination would cover a larger area.

Figure 1:
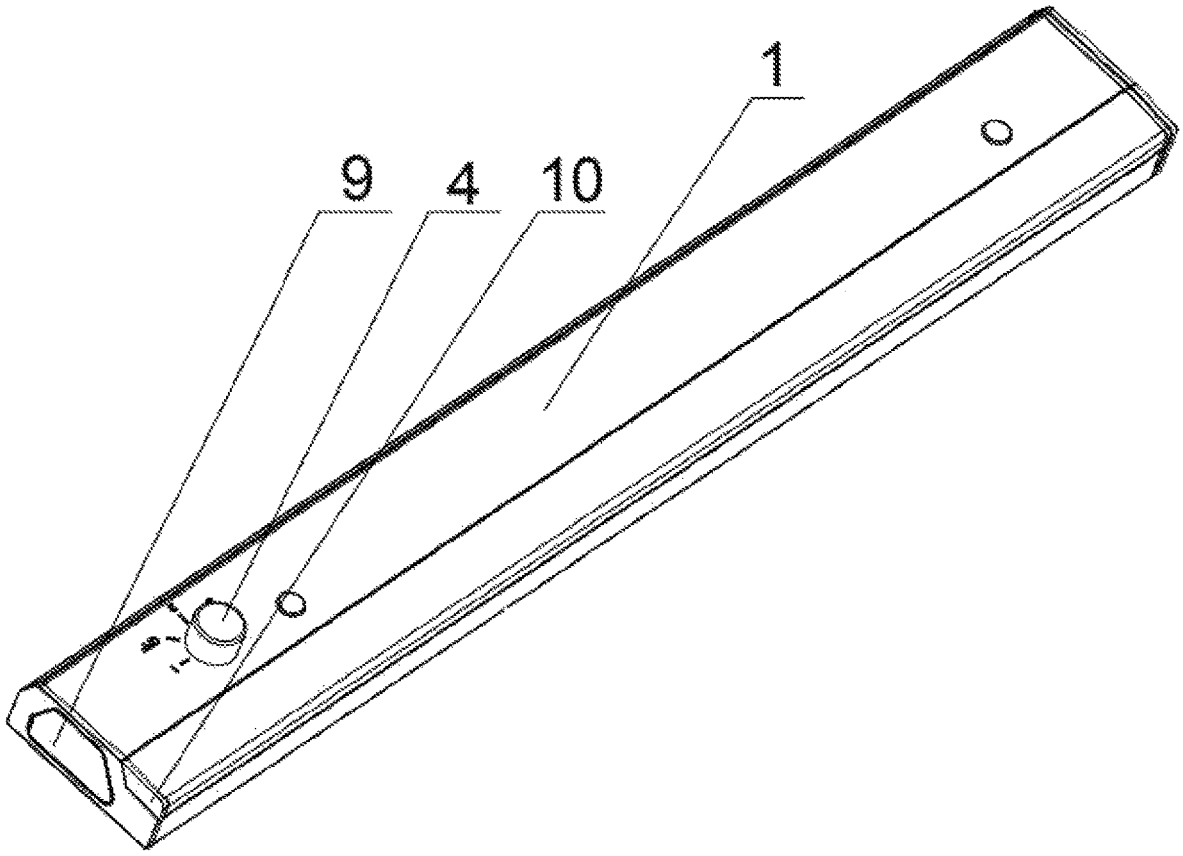
FIG. 1 is a schematic view showing the structure of a cabinet lamp of the present invention.
Figure 2:
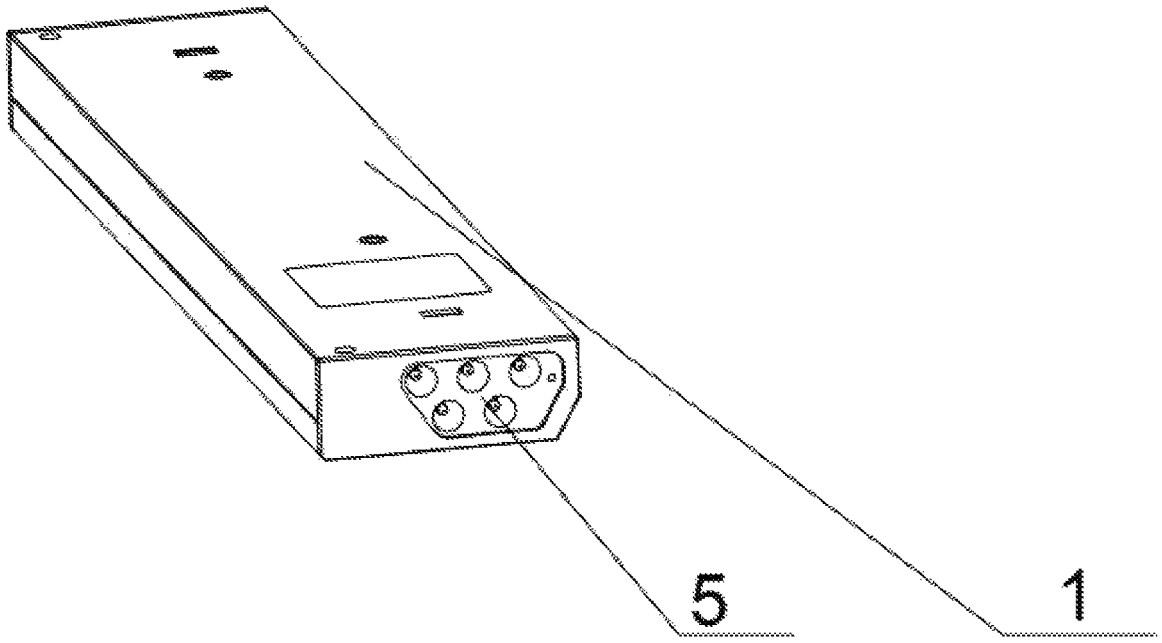
FIG. 2 is a schematic view showing the structure of another perspective of the cabinet lamp of the present invention.
Figure 3:
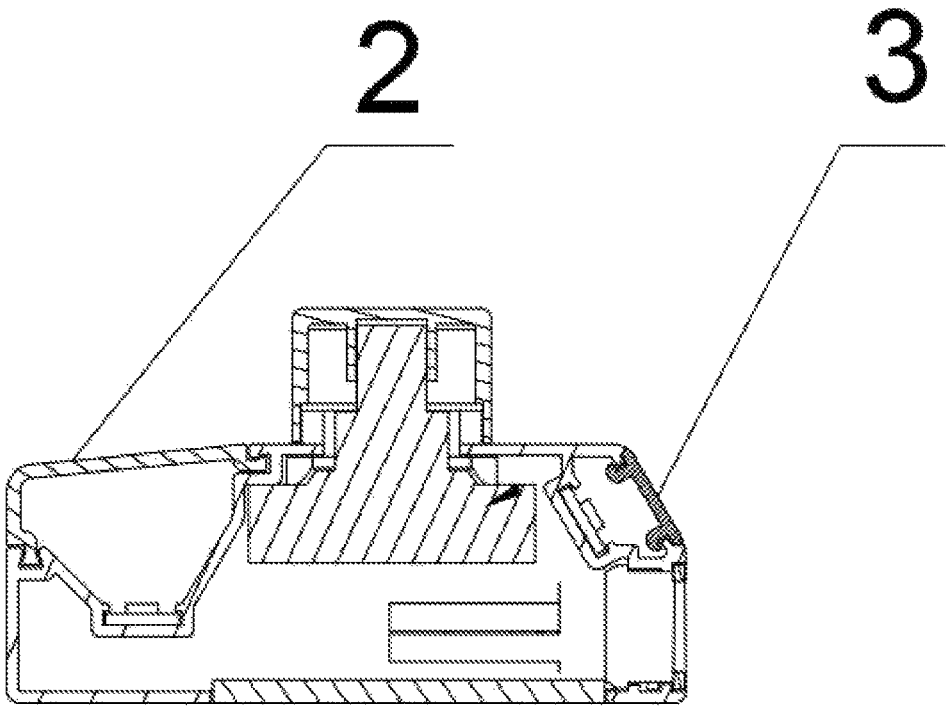
FIG. 3 is a cross-sectional view of the cabinet lamp of the present invention.
Figure 4:
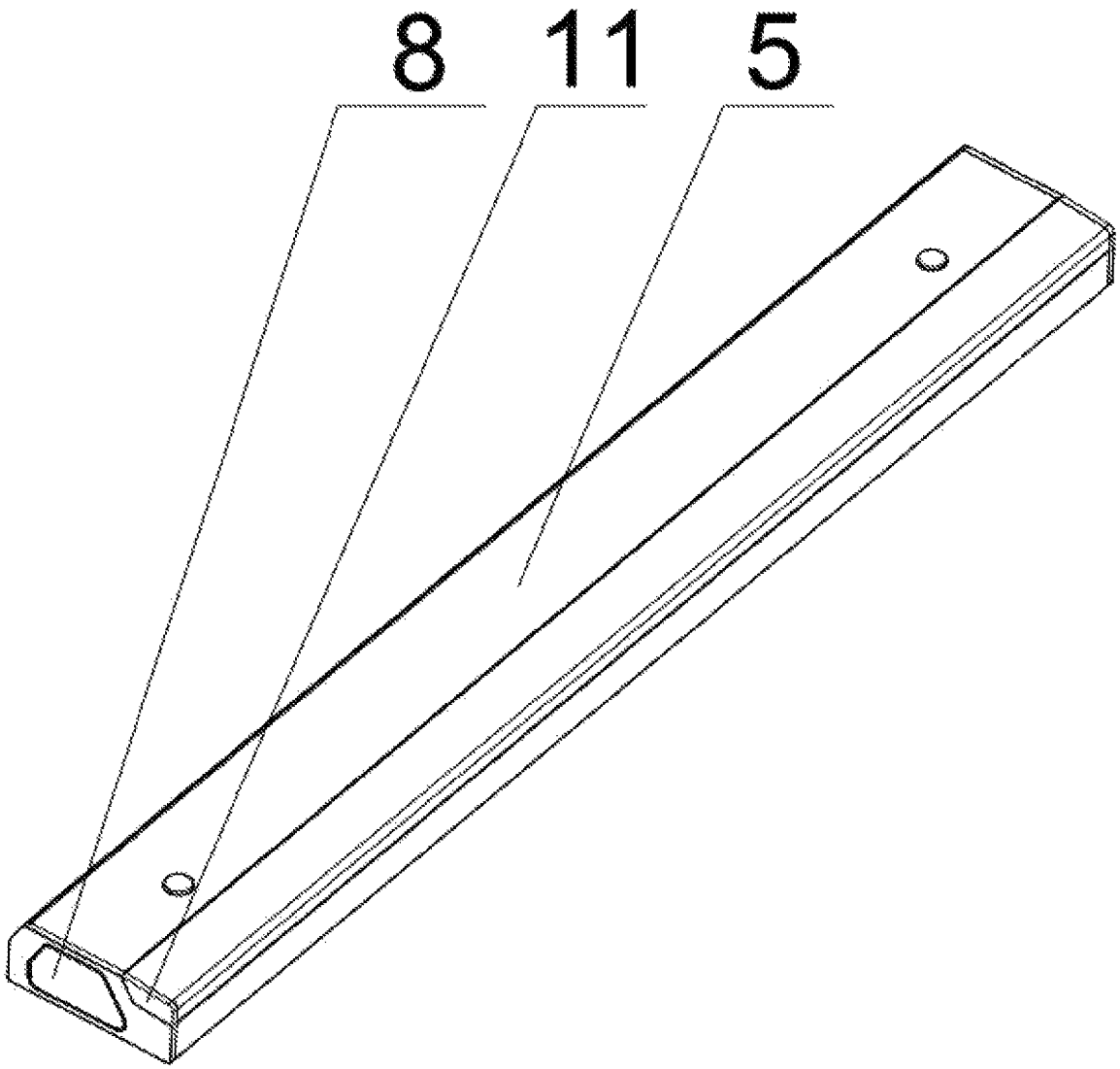
FIG. 4 is a schematic structural view of a sub-lamp assembly of the present invention.
Figure 5:
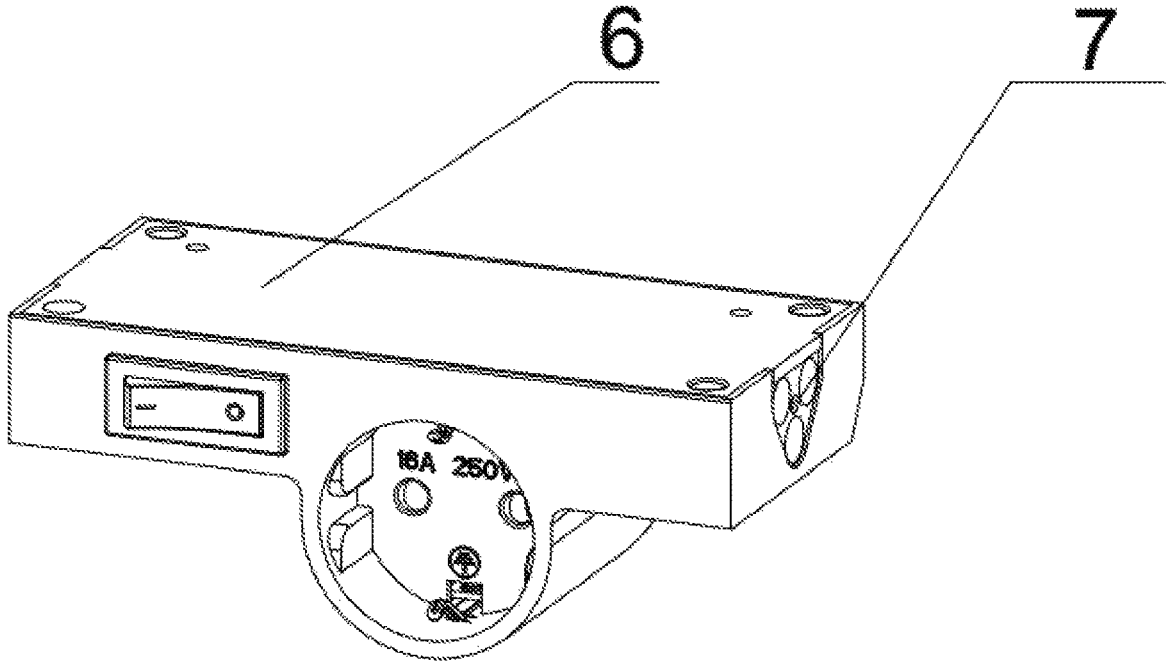
FIG. 5 is a schematic structural view of a socket component having a single-socket of the present invention.
Figure 6:
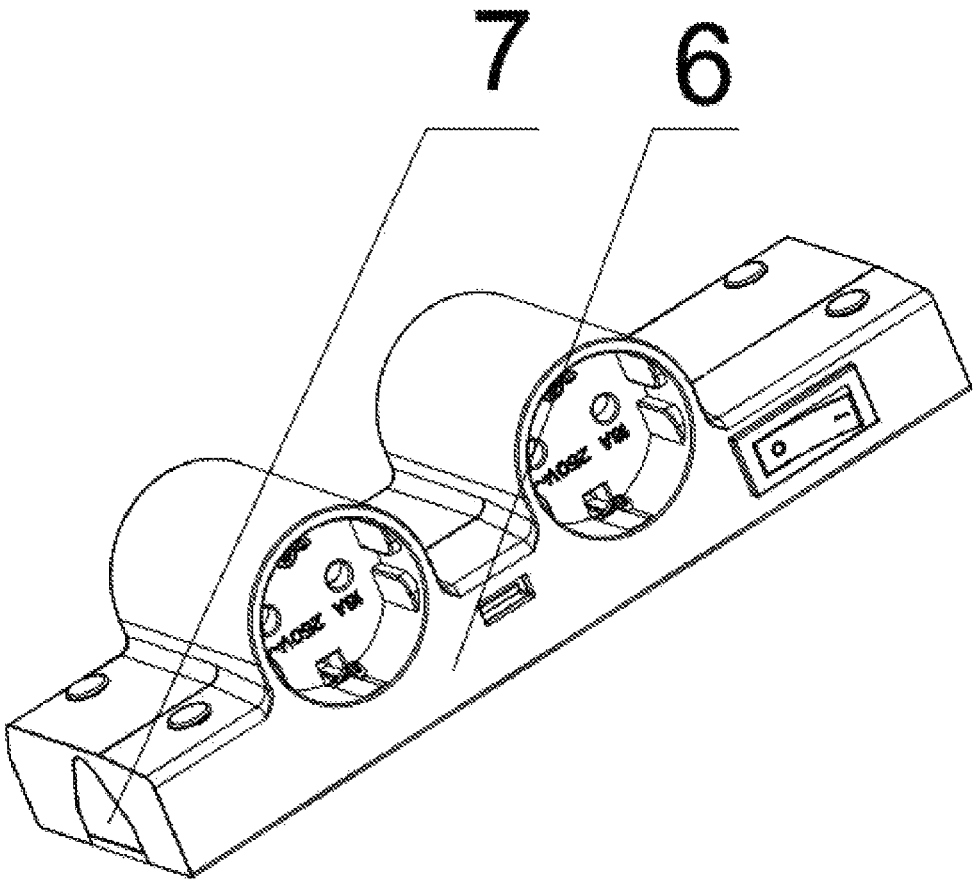
FIG. 6 is a schematic structural view of a socket component having double sockets of the present invention.
Figure 7:
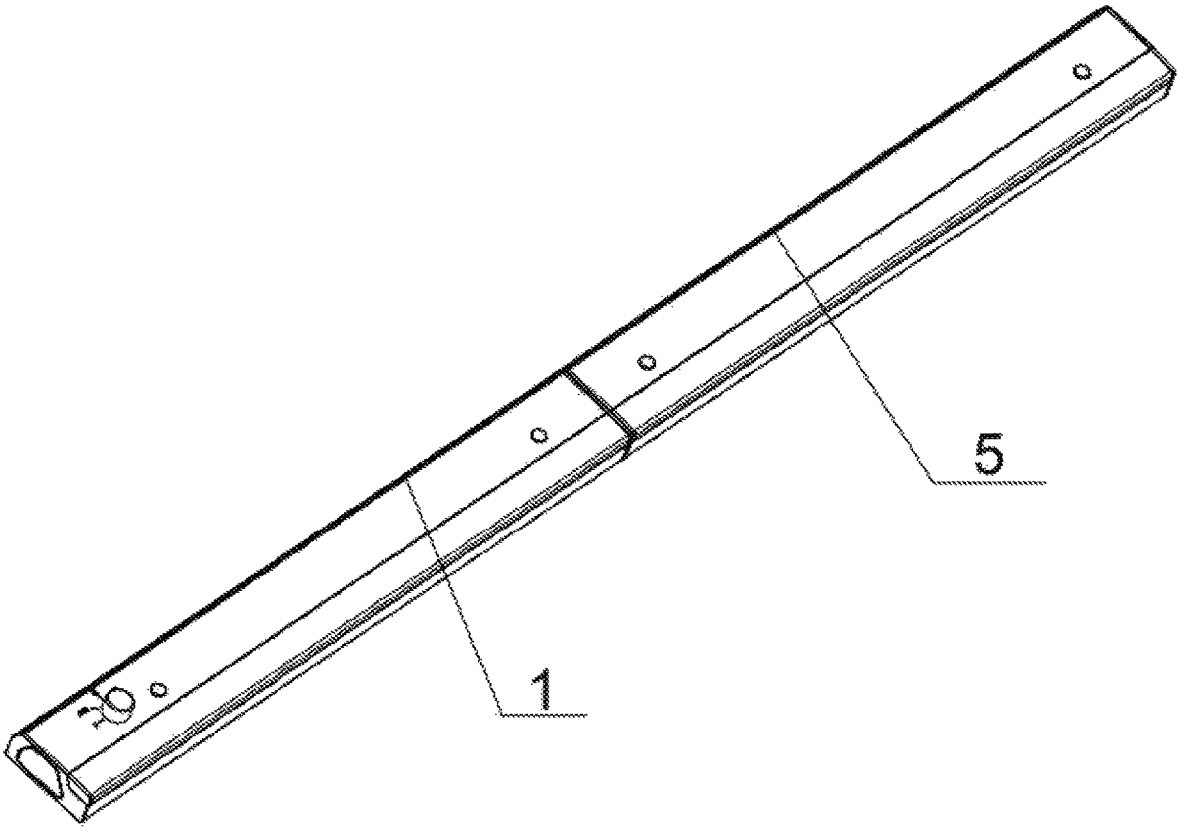
FIG. 7 is a structural schematic view showing the combination of the cabinet lamp and the sub-lamp assembly of the present invention.
Figure 8:
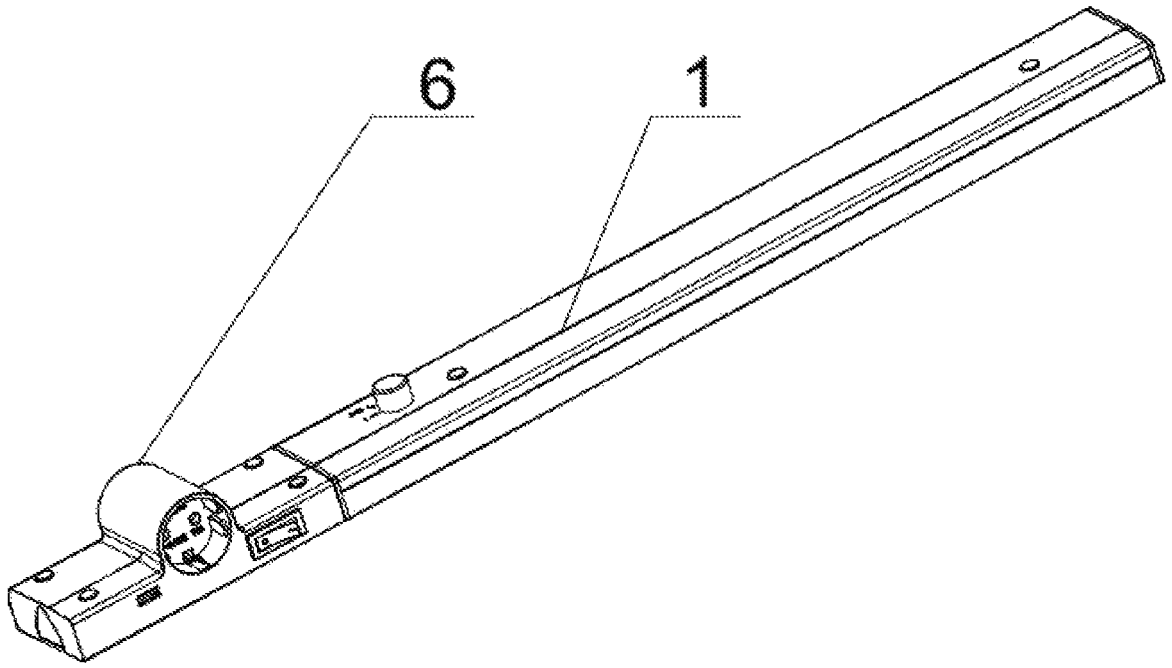
FIG. 8 is a schematic view showing the structure of the cabinet lamp and the socket component of the present invention.
Figure 9:
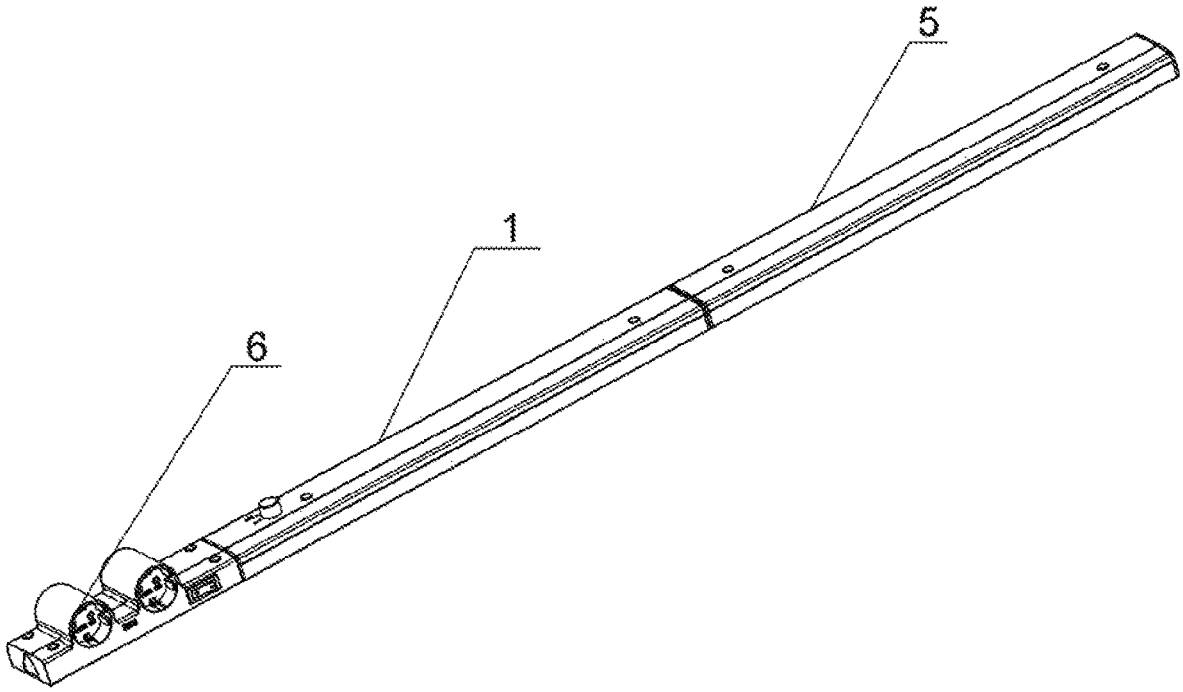
FIG. 9 is a schematic view showing the combined structure of the cabinet lamp and the sub-lamp assembly and the socket component of the present invention.

Reference Numbers: 1, the lamp body; 2, the primary light emitting surface; 3, the secondary light emitting surface; 4, the control switch; 5, the sub-lamp assembly; 6, the socket component; 7, the first port; 8, the second port; 9, the fifth port; 10, the first transparent area; 11, the second transparent area. The invention is further described below by way of specific embodiments, but the invention is not limited to the following specific embodiments.

In a first embodiment, a cabinet lamp combination includes a cabinet lamp primary lamp, a cabinet lamp sub-lamp, and a socket component 6.

The primary lamp of the cabinet lamp combination can also be referred to as a cabinet lamp hereinafter. It includes a lamp body 1, a wiring plug disposed on the lamp body 1, a processor disposed in the lamp body 1, a light emitting surface disposed on the front and rear sides of the lamp body 1, a light emitting assembly disposed in the light emitting surface, a fifth port 9 disposed on each of the left and right sides of the lamp body 1, and a control switch 4 disposed on the lamp body 1. The wiring plug, the light emitting assembly, the fifth port 9, and the control switch 4 are all electrically connected to the processor.

The light emitting surfaces on both sides are the primary light emitting surface 2 and the secondary light emitting surface 3, respectively. A primary light emitting component is disposed in the primary light emitting surface 2, and a secondary light emitting component is disposed in the secondary light emitting surface 3. The primary light emitting surface 2 has an L-shape. The longer part of the L-shape is located at the bottom of the lamp body 1. The shorter part of the L-shape is located at the front side of the lamp body 1. The orientation of the primary light emitting component is towards the bottom of the lamp body 1, so that the primary light emitting surface 2 on the front side of the lamp body 1 emits only a part of the reflected light, which would not produce a glare effect. The secondary light emitting surface 3 is disposed on the rear side of the lamp body 1 and is inclined. The inclination angle may be 30-60°. The orientation of the secondary light emitting component is the same as the secondary light emitting surface 3. Because it illuminates backwards, there would be no glare produced.

The control switch 4 is a knob switch, which can control the brightness and darkness of the light emitting component. There are four states, which correspond to occasions of minimal illumination, maximal illumination, partial illumination when the primary light emitting component is powered on, and partial illumination when the secondary light emitting component is powered on.

The fifth port 9 is disposed on each of the left and right sides of the lamp body 1, and the fifth port 9 includes five connectors, respectively, an L connector, a GE connector, an N connector, an L1 connector, and an L2 connector. The L connector, the GE connector, and the N connector form a third port. The N connector, the L1 connector, and the L2 connector form a fourth port.

The cabinet lamp sub-lamp, also known as the sub-lamp assembly 5, has the same structure as the primary lamp of the cabinet lamp, and it has two light emitting surfaces and two light emitting components. The angles of the light emitting surface and the light emitting component are the same, but no control switch 4 is provided. The port is not the same as that on the primary light of the cabinet lamp, Each of the two sides of the sub-lamp is respectively provided with a second port 8. The second port 8 has only three joints to match with the fourth port. It can be directly plugged in the fourth port or indirectly plugged into the fourth port through a connector to be powered on. Synchronous control can also be performed through the control switch 4 on the primary lamp.

The socket component 6 includes at least one socket and a switch for controlling the powering on and off of the socket. In the specific embodiment, there is one socket, but two sockets may be provided. A USB charging port is also provided. The first port 7 is provided on each side of the socket component 6 to be matched with the third port. It can be directly plugged into the third port or indirectly connected to the third port through a connector to be powered on.

A second embodiment differs from the first embodiment in that, in the second embodiment, a part of end plates on the two sides or ends of the primary lamp and the sub-lamp of the cabinet lamp may be transparent. A first transparent area 10 is disposed on the primary lamp, and a second transparent region 11 is disposed on the sub-lamp. The positions of the transparent areas of the primary lamp and the sub-lamp are the same. The size of the transparent portion is the same as the cross-sectional shape of the internal space of the primary light emitting surface 2. The light emitting component can illuminate the opposite side through the transparent area. The transparent area is integrally formed on the end plate. They can be formed by two different materials, or both of them can be made of a transparent material but some parts are coated with opaque materials. The structure is arranged such that when the primary lamp and the sub-lamp are combined, there will be less or no dark areas between the two. When the light emitted by the primary light emitting component is incident on the sides of the lamp body 1, it is also incident on the transparent areas. Then, the light propagates into the sub-lamp through the two transparent portions. The primary light emitting component on the sub-lamp has a similar mechanism.

The cabinet lamp of the present application can be used in a separate primary lamp of the cabinet lamp, or a primary lamp with sub-lamps on one or both sides thereof, or a primary lamp with a socket component 6 on one side, or a primary lamp with a socket component 6 on one side and a sub-lamp on the other side. The specific combination of such types can be determined by a user's choice.

It should be noted that the above embodiments are only for explaining the technical solutions of the present invention, and are not intended to be limiting. Although the present invention has been described in detail with reference to the foregoing embodiments, those skilled in the art will understand that the technical solutions described in the foregoing embodiments can be modified, and some of the technical features may be replaced by the same. These modifications and substitutions do not depart from the spirit and scope of the technical solutions of the embodiments of the present invention.

We claim:

1. A combination luminaire comprising:

a cabinet lamp;

a sub-lamp assembly; and a socket component, wherein the cabinet lamp comprising:

a lamp body having at least a front side, a bottom side, and a rear side; and two light emitting surfaces, each provided on at least a portion of at least two of the sides of the lamp body;

wherein both the sub-lamp assembly and the socket component are electrically detachably connected to the cabinet lamp;

wherein, the cabinet lamp further comprising end plates at respective left and right ends of the lamp body, each of such end plates include a first transparent area;

the sub-lamp assembly further comprising end plates at respective left and right ends of the sub-lamp assembly, each of such end plates include a second transparent area, wherein the first transparent area on one end of the cabinet lamp corresponds to the second transparent area on one end of the sub-lamp assembly when the sub-lamp assembly is connected to the cabinet lamp.

2. The cabinet lamp according to claim 1, further comprising:

a first light emitting component provided in the primary light emitting surface;

a second light emitting component provided in the secondary light emitting surface;

a processor; and a control switch, wherein each of the light emitting components and the control switch are electrically connected to the processor.

3. The combination luminaire according to claim 1, wherein the socket component has a first port, the sub-lamp assembly has a second port, the cabinet lamp has a third port configured for receiving the first port and a fourth port configured for receiving the second port, the socket component is electrically connected to the cabinet lamp when the first port is received by the third port, and the sub-lamp assembly is electrically connected to the cabinet lamp when the second port is received by the fourth port.

4. The combination luminaire according to claim 3, wherein the third port and the fourth port are arranged to form a fifth port.

5. The cabinet lamp according to claim 1, wherein the two light emitting surfaces are respectively a primary light emitting surface and a secondary light emitting surface, the primary light emitting surface is L-shaped and disposed on a portion of the front side of the lamp body, and the secondary light emitting surface is disposed on the rear side of the lamp body and arranged obliquely with respect to at least a portion of the bottom side.

6. The cabinet lamp according to claim 5, wherein an area of the primary light emitting surface is further disposed on at least a portion of the bottom side of the lamp body, such bottom side portion of the primary light emitting surface is larger than the front side portion of the primary light emitting surface.

* * * * *